United States Patent [19]

Juda et al.

[11] 4,412,894

[45] Nov. 1, 1983

[54] PROCESS FOR ELECTROWINNING OF MASSIVE ZINC WITH HYDROGEN ANODES

[75] Inventors: Walter Juda, Lexington; Robert J. Allen, Saugus; Amiram Bar-Ilan, Newtonville, all of Mass.

[73] Assignee: Prototech Company, Newton, Mass.

[21] Appl. No.: 280,795

[22] Filed: Jul. 6, 1981

[51] Int. Cl.[3] ..... C25C 1/16

[52] U.S. Cl. ..... 204/119

[58] Field of Search ..... 204/119, 256, 258, 265, 204/270, 277

[56] References Cited

U.S. PATENT DOCUMENTS

| | | | |
|---|---|---|---|
| 1,210,017 | 12/1916 | Tainton | 204/119 |
| 2,913,377 | 11/1959 | Brown | 204/119 |
| 3,103,474 | 10/1963 | Juda | 204/104 |
| 3,124,520 | 3/1964 | Juda | 204/86 |

OTHER PUBLICATIONS

"Zinc—The Science and Technology of the Metal, its Alloys and Compounds," edited by C. H. Mathewson, American Chemical Society Monograph Series, Rhinehart Publishing Corporation, NY, 1959, p. 178.

AIME World Symposium on Mining, Metallurgy of Lead & Zinc, pub. by American Institute of Mining, Metallurgical, & Petroleum Engineers, Inc., NY, NY 1970, pp. 178, 198–200, 210, 213, 223, 239, 247–248, 267, 269–270, 308.

"The Gas Electrodes—A Study of Phenomena of Mass & Charge Transfer from Activation Energy Measurements" by G. Bianchi, et al., in the Proceeding of Deuxiemes Journees Internationales de'Etude des Piles a Combustibles, (2nd Internat'l Study Days of Fuel Cells), 1967, FIG. 2, p. 154.

"Fuel Cell, A Review of Government Sponsored Research," 1950–1964, L. G. Austin, Office of Technology Utilization, National Aeronautics and Space Adminstration, 1967, p. 3.

*Primary Examiner*—R. L. Andrews

*Attorney, Agent, or Firm*—Rines and Rines

[57] ABSTRACT

This disclosure is concerned with electrowinning massive zinc with hydrogen anodes and with critical concentration ranges of $Zn++$ in the electrolyte and of free sulphuric acid, adjusted for optimum energy considerations.

4 Claims, 3 Drawing Figures

PROCESS FOR ELECTROWINNING OF MASSIVE ZINC WITH HYDROGEN ANODES

Figure 1:
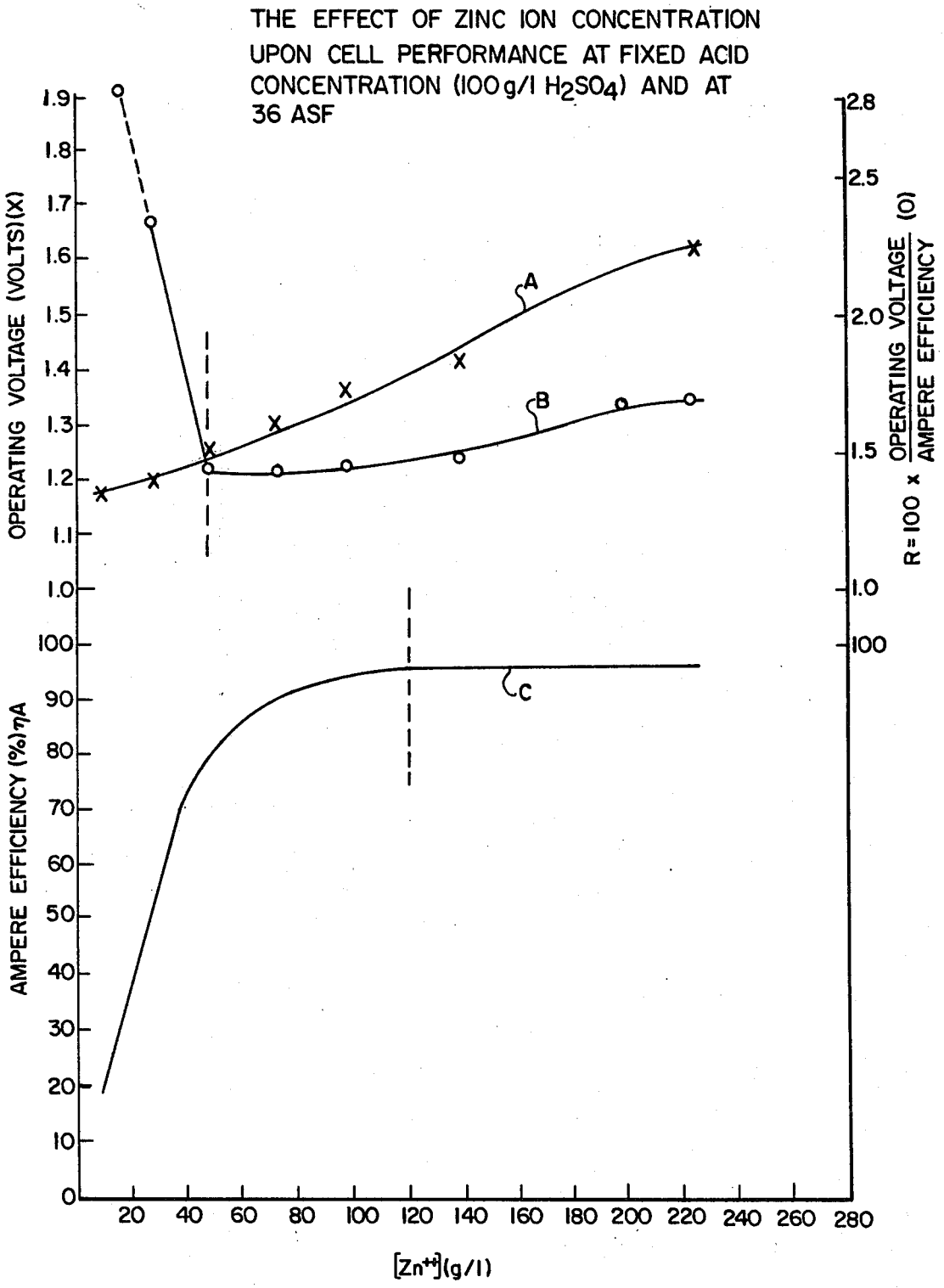

The present invention relates to the electrowinning of massive zinc, being more particularly directed to such electrowinning in a cell comprising a hydrogen anode electrode and a "doped" aqueous electrolyte solution of zinc sulfate and sulfuric acid, employed in common with a cathode electrode and in critical concentration ranges.

Among the metals commercially produced by electrolysis with conventional lead anodes, massive zinc produced by electrowinning is a special case, in that it is produced in much larger quantities and sells at a much lower price than any of the other such metals while consuming electric energy far in excess of the others. Further, as stated, for example, in "Zinc—The Science and Technology of the Metal, its Alloys and Compounds," edited by C. H. Mathewson, American Chemical Society Monograph Series, Rhinehart Publishing Corporation, New York, 1959, p. 178, "The hydrometallurgy of the process becomes complex due to the very narrow margin by which it is possible to deposit zinc from a solution by electrolysis. The comparatively low market value of zinc adds to the problem, causing the economic necessity of producing zinc at a low cost and a high recovery."

This and other publications, including, for example, AIME World Symposium on Mining, Metallurgy of Lead and Zinc, published by the American Institute of Mining, Metallurgical, and Petroleum Engineers, Inc., New York, NY, 1970, describe in detail the stringent requirements of electrolyte composition and purity which, in conjunction with well-defined ranges of current density, temperature and other factors, have made conventional zinc electrowinning a major industry.

Typically, in the conventional process, only a moderate level of free acid concentration, on the order of 100 g/l, is allowed to build up while adequate levels of zinc sulfate concentrations are maintained in the course of the electrolysis. These levels are conveniently controlled, for example, by a feed-and-bleed system in which a portion of the moderately acidic electrolyte is periodically withdrawn and replaced by an equivalent amount of neutral zinc sulfate. In commercial practice, the acidic bleed is neutralized with zinc oxide, purified and fed back into the electrolysis cell.

As described in detail in the above publications, careful electrolyte purification procedures, largely based on the addition of zinc dust, are used substantially to eliminate from the electrolyte those trace impurities which lower the hydrogen overvoltage and thus decrease the ampere efficiency. The electrolyte must then be "doped" with additives, namely certain high molecular weight organic compounds which, upon prolonged electrolysis, maintain high hydrogen overvoltage and thus high ampere efficiency. Such additives include glue, gelatin, polyacrylamide (sold under the trade name SEPARAN) and others. Current densities range from 25 to as much as 100 amperes per square foot (ASF).

Thus, the economical electrowinning of massive "tree-free" zinc usually in the form of thick sheets (generally more than 30 mils) requires (1) maintaining moderate current densities and high (i.e. in excess of 85%) current efficiencies for periods of eight to twenty-four or more hours of continued electrolysis per sheet, and (2) "doping" the electrolyte with organic additives capable of sustaining the current efficiency throughout the electrolysis, apparently by raising hydrogen overvoltage of local low overvoltage spots which tend to form gradually on the zinc cathode during prolonged electrolysis.

In contrast to the above, electrogalvanizing involves plating rapidly thin coatings (one to a few mils) on iron and the like at very high current densities and voltages and correspondingly very low current efficiencies, causing heavy hydrogen gas evolution. The purpose is to maximize the electrolyte plating rate per unit of galvanized iron at the expense of high voltages and low current efficiencies, because the resulting low cost of investment amortization per such unit more than compensates for the energy inefficiency. Moreover, it is unnecessary to "dope" the electrolyte with additives as their beneficial effect only comes into play during prolonged electrolysis.

An optimum temperature range of 30°–40° C. is maintained by cooling because ampere efficiency suffers at higher temperatures. In addition, lead contamination of the zinc cathode, originating from the conventional anode, increases with temperature. The theoretical decomposition voltage of zinc sulfate is 2.35 volts, but the commercial value with lead anodes is about 2.67 volts (see Mathewson reference above, p. 201–202). The actual applied voltage is in excess of 3 volts and increases with current density.

The energy consumption, in kilowatt-hours per pound of zinc (KWH/lb), is proportional to voltage and current density and inversely proportional to the ampere efficiency. Capital cost decreases almost proportionately with increasing current density. Thus, a balance optimizing energy costs and captial amortization costs leads to operation conditions depending upon local cost conditions. In general, however, in view of the ever-increasing cost of capital and of energy, the viability of the conventional process is becoming more and more questionable.

In the fuel cell art it is well known that hydrogen anodes in sulfuric acid function best in pure concentrated acid solutions, the optimum concentration being about 4 molar, as shown, for example, in the article entitled "The Gas Electrodes—A Study of Phenomena of Mass and Charge Transfer from Activation Energy Measurements" by G. Bianchi, G. Fiori, t. Mussini, and A. Orlandi in the Proceeding of "Deuxièmes Journées Internationales de'Etude des Piles à Combustibles" (Second International Study Days of Fuel Cells), 1967, FIG. 2, page 154. Such acid concentration, however, is entirely unsuitable in zinc electrowinning, as demonstrated below.

Moreover, it is known that in the case of fuel cell electrodes, the catalytic properties are destroyed by adsorption of impurities which poison the surface of the electrodes (see Fuel Cell, A Review of Government Sponsored Research, 1950–1964, L. G. Austin, Office of Technology Utilization, National Aeronautics and Space Administration, 1967, p. 3). One of the causes of performance decay with time is the catalyst poisoning by impurities in the electrolyte (ibid., p. 8). Thus, the typical mildly acid *doped* zinc sulfate electrolyte suitable for cathodic zinc electrowinning with near quantitative ampere efficiency would appear to be useless as an electrolyte in contact with a hydrogen anode.

In the earlier U.S. Pat. No. 3,103,474 (1963) of applicant Walter Juda herein, an electrowinning cell is described in which the conventional lead anode is replaced by a hydrogen anode thereby realizing significant voltage savings in the electrolytic plating of copper, iron, zinc, chromium, nickel, manganese, cobalt and cadmium. With regard to zinc, example 6, col. 7 of this patent describes electrogalvanizing of an iron cathode utilizing a neutral zinc sulfate solution, which is an unsuitable electrolyte for the hydrogen anode in electrowinning of massive zinc as more fully shown below.

Moreover, the voltage saving due to the hydrogen anode reported in the table in col. 6 of U.S. Pat. No. 3,103,474 was demonstrated with a metal ion-free and additive-free concentrated sulfuric acid solution containing about 380 g/l which concentration is incompatible with zinc electrowinning at high current efficiencies. For this reason, to obtain high current efficiency and at the same time attain a voltage saving due to the hydrogen anode, the said earlier patent used a porous diaphragm which evidently requires flowing a substantially neutral metal ion-containing catholyte through the diaphragm to become the acid anolyte as the hydrogen ion is generated at the anode (col. 4, line 60–69). In this mode of operation, in addition to the added complication of an additional component, the acid concentration of the anolyte is usually too low for proper functioning of the hydrogen anode. To overcome this drawback, another electrowinning cell substituting a hydrogen anode for the conventional insoluble (e.g. lead) anode and including an ion-exchange membrane has been described in another prior Juda U.S. Pat. No. 3,124,520, the ion exchange membrane permitting the choice of the electrolyte most suited for the particular fuel electrode (col. 4, lines 6–7), such as the 4-molar concentrated sulfuric acid solution referred to above. If the latter were in contact with the metal cathode, it would lower the current efficiency to an unacceptable level. In the fuel-membrane mode of U.S. Pat. No. 3,124,520 in which the fuel anode is in "face-to-face" (col. 2, line 5) contact with the membrane, the benefit of the hydrogen anode is largely offset because the high metal ion content of the electrolyte solution converts the ion-exchange resin largely to the metal form, thereby not only introducing a high electrical resistance, but also decreasing the hydrogen ion concentration in contact with the hydrogen anode, which adversely affects the hydrogen gas-hydrogen ion reaction. The two-compartment mode of U.S. Pat. No. 3,124,520 overcomes the latter drawbacks, but introduces, in addition to an electrical resistance, an undesireable acid back-diffusion effect. In general, the use of an ion-exchange membrane or any other diaphragm-type separator in an electrowinning cell is a complication compounding increasing captial and operating (i.e. membrane replacement) costs with the above-mentioned disadvantages.

Surprisingly, we have now found that a single common aqueous doped acid zinc sulfate electrolyte solution contacting the cathode and the hydrogen anode and comprising critical ranges of zinc-ion concentration and free sulfuric acid concentration results in high current efficiencies, of the order of 85% or better, during prolonged electrolysis, and entirely proper performance of the hydrogen anode, thus resulting in substantial voltage savings.

The art is replete with descriptions of hydrogen anodes suitable for the purpose of this invention. Typically, the hydrogen anodes described in U.S. Pat. Nos. 4,044,193 and 4,248,682 commonly owned, and incorporated herein by reference, are suitable for the purpose of this invention, although many others described in the literature are also applicable thereto.

In addition to the corresponding advantage of low energy consumption by comparison with the processes of the prior art, other important benefits result from the present invention.

As is well known, conventional zinc electrowinning utilizing lead anodes suffers from the so-called acid mist which is produced at the anode by the oxygen gas evolution thereon. The acid mist pollutes the atmosphere of the tank house requiring expensive ventilation. Replacing the lead anode with the hydrogen anode replaces the anodic oxygen gas evolution with the $H_2/H^+$ anodic reaction and thus eliminates the acid mist problem.

Further, conventional zinc electrowinning plants operate usually at the relatively low temperatures of 35°–40° C. and at low current densities in the range of 30–40 amp/sq. ft., building up, during electrolysis, a sulfuric acid concentration of the order of 100 g/l. This combination of operating conditions results in satisfactory current efficiencies, produces zinc plates, sufficiently low in lead content to be suitable for many important uses and yields an electrolyte bleed from the cells which has the required acidity for leaching zinc oxide concentrate, to form a fresh electrolyte feed to the cells.

But maintaining the cells at 35°–40° C. requires usually expensive cooling; and operating at higher than about 40 ASF current density, which is very desireable indeed to reduce the high tankhouse capital cost, is commonly ruled out because it results in excessive lead contamination of the zinc, due to anodic lead dissolution.

We have now found that the process of this invention can be carried out at temperatures up to about 60° C. (making it possible to avoid or minimize cooling) with no such lead contamination and without significant sacrifice of current efficiency. Temperatures in excess of about 75° C. are undesireable because of hydrogen reduction of sulfate to sulfide. And we have further found that the process of this invention can be carried out at current densities far in excess of the 30–40 amps/sq ft range, (again without causing such lead contamination of the zinc) the upper limit being primarily set by economic considerations of optimizing capital and operating costs.

Referring now to the electrowinning process of U.S. Pat. No. 3,124,520 utilizing for example, a two-compartment cell with a hydrogen anode and a cation exchange membrane, (separating the anolyte from the catholyte), here part of the sulfuric acid in the anolyte diffuses inevitably across the ion exchange membrane into the zinc bearing catholyte, thereby continuously adding acid to the effluent from the cell. In the subsequent recycling process this partially depleted catholyte effluent is enriched in zinc by leaching the zinc concentrate, and then fed back to the cell. The continuous buildup of diffused acid from the anolyte requires periodic elimination of excess sulfate to maintain a material balance. Such elimination constitutes not only a loss of acid, but carries with it a loss of zinc. By eliminating the ion exchange membrane with its separate acid feed, the present invention retains the desired material balance between electrowinning and concentrate-leaching of the conventional lead anode process, while at the same time realizing the above-described advantages.

An object of the present invention, accordingly, is to provide a novel zinc electrowinning process that is not subject to the above-described limitations, but produces highly economical operation through employing critical ranges of $Zn^{++}$ and free $H_2SO_4$ in a hydrogen anode cell.

Other and further objects are explained hereinafter and are more particularly delineated in the appended claims.

In summary, from one of its viewpoints, the invention embraces a process for electrowinning massive zinc at a temperature between about ambient and about 75° C. and at a cathodic ampere efficiency in excess of about 85% in a driven single-compartment cell comprising a zinc cathode electrode and a spaced porous hydrophobic hydrogen anode electrode, the process comprising the steps of providing said cell with a common electrolyte contacting both said electrodes, said electrolyte being a purified doped aqueous solution of zinc sulfate and free sulfuric acid; adjusting said solution to contain a sufficient concentration of zinc, as zinc sulfate, to enable cathodic deposition of zinc at said ampere efficiency, and to contain free sulfuric acid in amount within a concentration range that enables attainment of the voltage benefit of the anodic hydrogen gas-hydrogen ion reaction without adversely affecting said cathodic ampere efficiency; passing an electrolysis current through said cell; supplying hydrogen gas to said anode in amount sufficient to prevent anodic oxygen evolution during said electrolysis; and maintaining said zinc and free acid concentrations during said electrolysis. Preferred details and best mode embodiments are later presented.

Figure 2A:
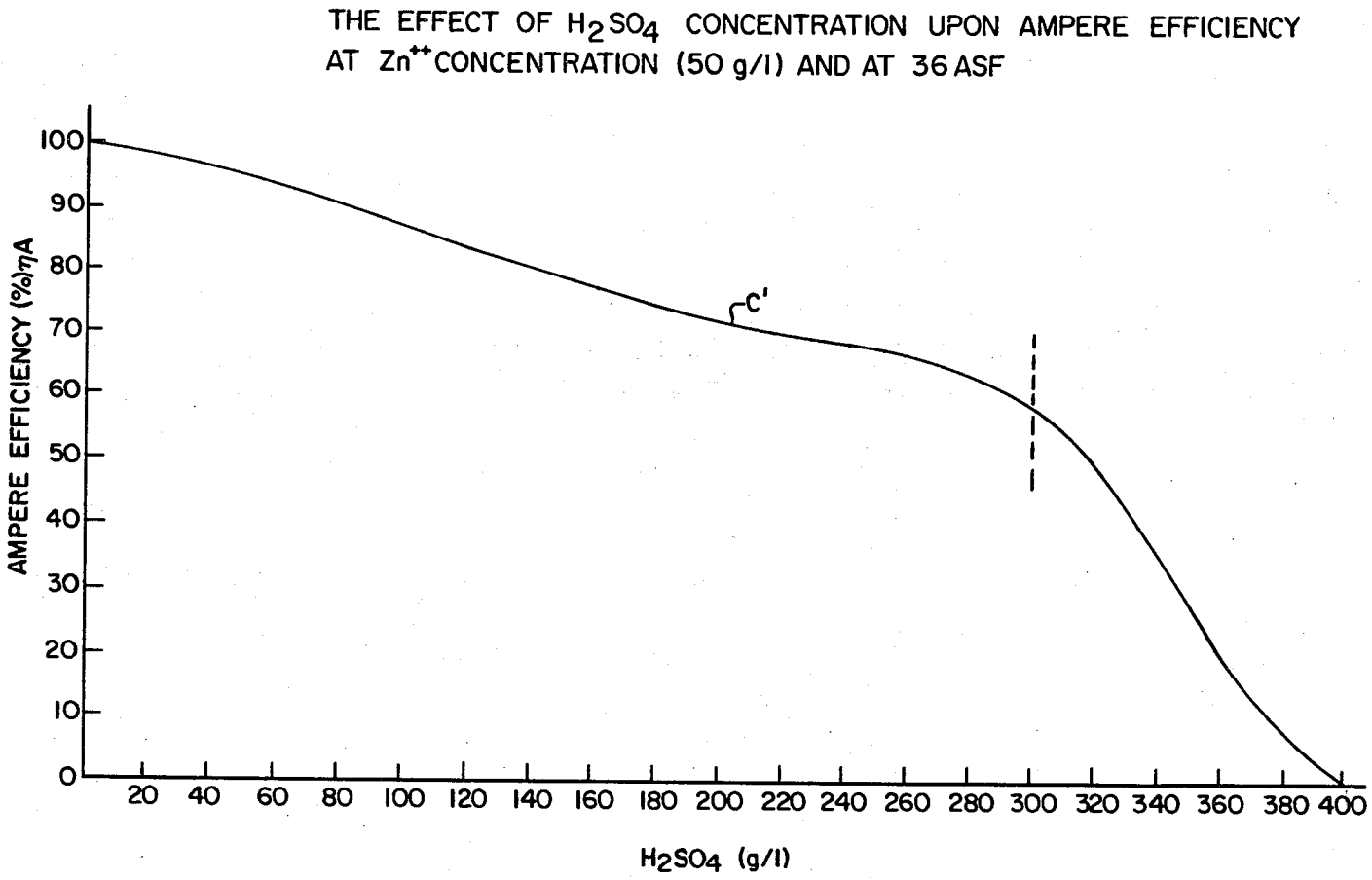
Figure 2B:
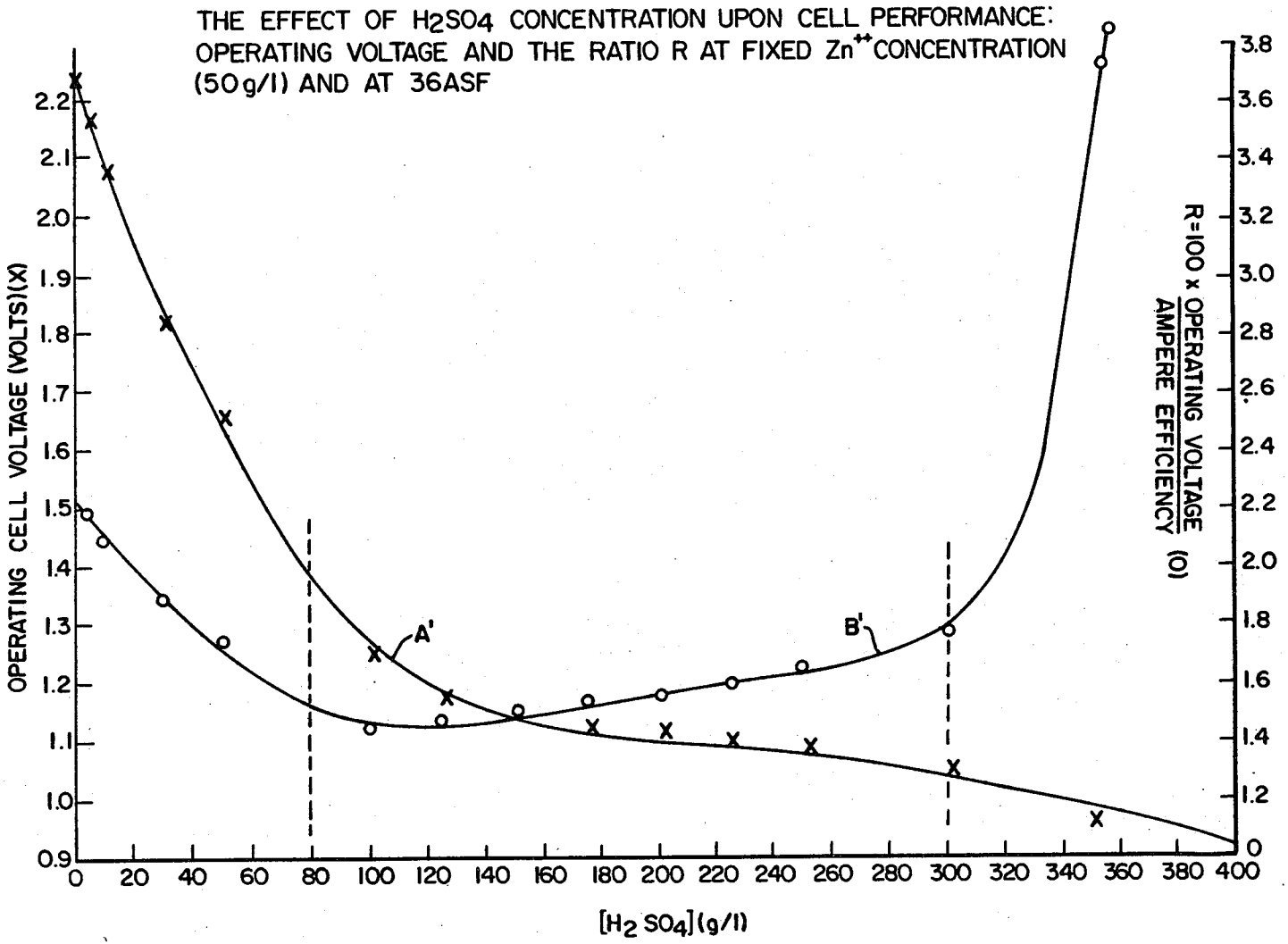

The invention will now be described with reference to the accompanying drawings in which FIG. 1 is a graph demonstrating a critical range of $Zn^{++}$ for optimum efficiency in the prefered hydrogen anode cell of the invention; and FIGS. 2A and 2B are similar graphs defining optimum $H_2SO_4$ concentration ranges.

Underlying the present invention, indeed, is the discovery that, in electrowinning cells for producing massive zinc at temperatures between about ambient and about 75° C., there are rather optimum concentrations of zinc in doped electrolyte solutions that enable cathodic deposition at the cathode, operating with a porous hydrophobic hydrogen anode, with cathodic ampere efficiency in excess of about 85%. Concurrently with the above, an optimum concentration range of sulfuric acid in the electrolyte solution has been found that enables the attainment of the voltage benefit of the anodic hydrogen gas-hydrogen ion reaction without adversely affecting such cathodic ampere efficiency; the invention thus providing identification of optimal concentrations in the zinc electrowinning solution with regard to energy savings.

As a first example, studies were conducted as to the effect of zinc ion concentration upon cell performance at 36ASF with a 2 inch by 2 inch cell operated at about 55° C. and having the following conditions: $H_2SO_4$ concentration fixed at 100 g/l; electrolyte dopant: 0.1 g/l animal glue; run duration: 4 hours; as the preferred $Zn^{++}$ source: filtered (B&W) zinc sulphate solution; anode-cathode distance: 2"; $H_2$/Pt anode: a Pt-catalyzed carbon cloth used throughout the study, which contained 0.32 mg Pt/cm$^2$; hydrogen gas consumption: 70% of feed $H_2$; and hydrogen back pressure: 15 cm. $H_2O$.

The following parameters were determined in each case:

(a) cathodic zinc weight, CZW (grams of zinc deposited at the cathode);
(b) total coulombs of electricity invested, Q;
(c) % ampere efficiency, defined as:

$$n_A=(96{,}500\times 100\times CWZ)/(32.68\times Q)$$

where 32.68 is the gram-equivalent weight of zinc;
(d) operating cell voltage, V (volts);
(e) the ratio, R, of operating cell voltage to fractional ampere efficiency:

$$R=100\times V/n_A.$$

Since the energy consumption per run (KWH/lb Zn) is $$E=(454\times Q\times V)/(3.6\times 10^6\times CZW)$$

it follows from the definition of $n_A$ and R that E is directly proportional to R. Thus, values of the simple ratio R, are an indicator of relative energy expenditure.

FIG. 1 illustrates the distinct influence of $Zn^{++}$ concentration upon cell voltage V (curve A), ampere efficiency $n_A$ (curve C), and their ratio R (curve B), when the acid level and all other independent variables are fixed as above described. The gradual increase in cell voltage with $Zn^{++}$ concentration shown in curve A is due to increasing electrolyte resistance. Furthermore, ampere efficiency $n_A$ initially increases greatly with $Zn^{++}$ concentration in curve C, and begins to level off once the $Zn^{++}$ concentration exceeds 50–60 g/l. Above 100–120 g/l, $n_A$ is essentially stable at 95–96%.

Because of the nature of the dependence of V and $n_A$ on zinc concentration, there is a minimum in the curve B plotting the ratio R vs. zinc concentration. The initial, highly negative slope of this curve reflects the initial sensitivity of $n_A$ to zinc concentration. At high zinc concentration, with $n_A \cong 100\%$, R values substantially parallel those of V.

Since energy expenditure per pound of zinc (E) is directly proportional to the ratio (R) of cell voltage V to ampere efficiency $n_A$, it follows from the experimental results that there is a zinc concentration which minimizes the energy consumption of the fuel cell zinc electrowinning process (i.e., the zinc concentration which minimizes R). Though the minimum, however, is somewhat diffuse, energy investment per pound of zinc deposited is shown as minimized in the zinc concentration range of about 50–120 g/l, as represented by the dash-line vertical limits on the curves of FIG. 1. The energy cost is higher both at lower $Zn^{++}$ concentrations by virtue of poorer ampere efficiencies, and at higher zinc concentrations due to increasing cell voltage (i.e., increasing electrolyte resistance).

As another example, under the same operating conditions, above, analogous qualitative behavior was observed at the higher current density of 72 ASF, with ampere efficiency of 95.9% attained at about 200 g/l Zn concentration. Quantitatively, however, the energy cost per pound of Zn, as indicated by R, was always greater at 72 than at 36 ASF because of the greater cell voltages at the higher current density.

As before intimated, furthermore, the observed ampere efficiency is rather sensitive to the ratio of zinc ion and sulfuric acid concentrations. The optimization of the $H_2SO_4$ concentration at a fixed zinc ion concentration was then undertaken.

In a further exemplary experiment with the same cell, the steady-state Zn++ concentration was fixed at 50 g/l and the $H_2SO_4$ concentration was varied over the range 2–400 g/l. It was thereby possible to identify an optimal $H_2SO_4$ concentration with regard to ampere efficiency and energy savings.

FIGS. 2A and 2B illustrate the influence of $H_2SO_4$ concentration upon ampere efficiency $n_A$ (curve $C^1$ and FIG. 2A), cell voltage V (curve $A^1$ FIG. 2B), and the ratio of $V/n_A$ (curve $B^1$, FIG. 2B), when the zinc ion level and other remaining independent variables are fixed. The same qualitative pattern was observed here as earlier noted, with respect to the dependence of cell voltage, ampere efficiency and their ratio upon the $(Zn++):[H_2SO_4]$ ratio (which decreases, in the figures, as $[H_2SO_4]$ increases).

In the case of 36 ASF current density, the cell voltage (curve $A^1$) drops somewhat precipitously, and ampere efficiency (curve $C^1$) decreases slowly (while remaining above 86%) as $[H_2SO_4]$ increases from 2 to some 100 g/l, irrespective of current density. There is a correspondingly sharp decrease in the ratio R (curve $B^1$) which attains a minimum value when $[H_2SO_4]$ is close to 80–100 g/l. As $[H_2SO_4]$ increases to about 300 g/l, both the cell voltage (curve $A^1$) and ampere efficiency (curve $C^1$) decrease slowly, the latter to below 60%.

Further increase in $[H_2SO_4]$ from 300 to 400 g/l engenders a continued gradual decrease in operating cell voltage, while the ampere efficiency (curve $C^1$, FIG. 2A) decreases profoundly, down to 1%. Consequently, the ratio R rises very sharply to values two orders of magnitude greater than the minimum attained when $[H_2SO_4] \approx 100$ g/l. Preferred limit regions are accordingly illustrated by the dashed vertical lines in FIGS. 2A and 2B.

Thus, energy consumption (in KWH/lb Zn, which is proportional to R), goes through a minimum as $[H_2SO_4]$ is varied. It increases sharply at both very low and very high acid concentrations. The reasons for this behavior are not entirely identical to those behind the dependence of performance upon [Zn++], as before discussed, although there is similar qualitative dependence upon the $[Zn++]:[H_2SO_4]$ ratio.

At very low acid concentrations, ampere efficiency changes little from 99%. Furthermore, a high $[Zn++]:[H_2SO_4]$ ratio at very low $[H_2SO_4]$ also cause low electrolyte conductivity (which increases with $[H_2SO_4]$). Electrolyte IR drop and hence operating cell voltage are correspondingly high. Moreover, the catalytic hydrogen anode performs poorly at low $[H_2SO_4]$, which also contributes to the operating cell voltage.

When $[H_2SO_4]$ increases to 100 g/l, electrolyte resistance decreases, the hydrogen anode functions surprisingly well and operating cell voltage decreases appreciably. In addition, the $[Zn++]:[H_2SO_4]$ ratio remains sufficiently high to ensure satisfactory ampere efficiency. Thus the ratio R, or the energy consumed per pound of zinc, reaches a minimum.

Further increase in $[H_2SO_4]$ beyond 300 g/l causes the continued reduction in the electrolyte IR drop, albeit gradual. Proper hydrogen anode functioning continues and so there is a modest improvement (decrease) in cell voltage. However, at high acid levels, the $[Zn++]:[H_2SO_4]$ ratio becomes so low as adversely to affect ampere efficiency, which eventually approaches zero. As a result, the ratio R rises sharply.

Further experiments with the same cell and conditions, but with 72 ASF, showed that unlike at 36 ASF, the minimum was at some 125 g/l. Furthermore, at 36 ASF, R increased appreciably when $[H_2SO_4]$ rose above 100 g/l; whereas at 72 ASF, R remains relatively constant over a somewhat wider range of acid concentration (100–170 g/l). This phenomenon of enhanced "acid tolerance" with greater current density motivated additional study at still higher current densities.

At 90 ASF, accordingly, the ampere efficiency and cell voltage were explored and again each decreased as the acid concentration increased and the ratio R went through a minimum. The decrease in R at low acid concentrations was due mostly to the sharp decrease in electrolyte resistance which manifests itself in the operating cell voltage. R increased again at higher acid concentration with the sharp loss in ampere efficiency. At 90 ASF, R minimized at about 150 g/l $H_2SO_4$, and remained fairly constant up to some 200 g/l $H_2SO_4$. Thus, it appears true that the higher the current density, the higher is the "acid tolerance level" as expressed by the acid concentration at minimal energy consumption.

The curves of ampere efficiency vs. acid concentration at the three above current densities are generally similar. However, the voltage profiles differ. Indeed, it is the change in voltage that is primarily responsible for the shift in the condition of minimum energy consumption to higher acid levels as the current density is increased. The use of a larger cell (6 inch by 6 inch) was found to be apparently of little significance. It has thus been concluded that at any current density, the acid level may be fixed via the feed-and-bleed system so as to minimize the energy consumption per unit of cathodic zinc production In applying the above to a practical zinc electrowinning cell of several feet in depth, the hydrogen gas would preferably be supplied to more than one portion of the anode as by separate feeds at different levels of depth, with the hydrogen pressure adjusted to minimize electrolyte flooding of, and percolation of hydrogen gas through, such anode portions. The previously described rather critical concentration ranges of zinc sulfate or other suitable electrolyte and acid may be maintained by feeding such zinc sulphate or the like to the electrolyte and withdrawing a portion of the same, with the amounts of feed and withdrawal being controlled by the amount of acid generated in the electrolysis. Temperature control in the range between about 45° C. and 60° C. appears most useful within a broader range of from ambient to about 75° C.

Further modifications will occur to those skilled in the art, and such are considered to fall within the spirit and scope of the invention as defined in the appended claims.

What is claimed is:

1. A process for electrowinning massive zinc at a temperature between about ambient and about 75° C. and at a cathodic ampere efficiency in excess of about 85% in a driven single-compartment cell comprising a zinc cathode electrode and a spaced porous hydrophobic hydrogen anode electrode, the process comprising the steps of providing said cell with a common electrolyte contacting both said electrodes, said electrolyte being a purified aqueous solution of zinc sulfate and free sulfuric acid, said solution being doped with an organic additive capable of sustaining the ampere efficiency throughout the electrolysis; adjusting said solution to contain a sufficient concentration of zinc, as zinc sulfate, to enable cathodic deposition of zinc at said ampere efficiency, and to contain free sulfuric acid in amount within a concentration range that enables attainment of the voltage benefit of the anodic hydrogen gas-hydrogen ion reaction without adversely affecting said cathodic ampere efficiency; passing an electrolysis current through said cell; supplying hydrogen gas to said anode in amount sufficient to prevent anodic oxygen evolution during said electrolysis; and maintaining said zinc and free acid concentrations during said electrolysis, said concentration of zinc being maintained between about 50 g/l and about 200 g/l and said concentration range of free sulfuric acid being between about 80 g/l and about 300 g/l.

2. The process of claim 1 wherein said concentrations are maintained by feeding zinc sulfate to said electrolyte and withdrawing a portion of said electrolyte, the amounts of said free and withdrawal being determined by the amount of acid generated in said electrolysis.

3. The process of claim 1 wherein said current is passed at a cathodic current density exceeding about 35 ASF, and the temperature of the cell is controlled in the range between about 45° and about 60° C.

4. A process for electrowinning massive zinc at a temperature betwen about ambient and about 75° C. and at a cathodic ampere efficiency in excess of about 85% in a driven single-compartment cell comprising a zinc cathode electrode and a spaced porous hydrophobic hydrogen anode electrode, the process comprising the steps of providing said cell with a common electrolyte contacting both said electrodes, said electrolyte being a purified doped aqueous solution of zinc sulfate and free sulfuric acid; adjusting said solution to contain a sufficient concentration of zinc, as zinc sulfate, to enable cathodic deposition of zinc at said ampere efficiency, and to contain free sulfuric acid in amount within a concentration range that enables attainment of the voltage benefit of the anodic hydrogen gas-hydrogen ion reaction without adversely affecting said cathodic ampere efficiency; passing an electrolysis current through said cell; supplying hydrogen gas to said anode in amount sufficient to prevent anodic oxygen evolution during said electrolysis; and maintaining said zinc and free acid concentrations during said electrolysis, and wherein said spaced electrodes are positioned vertically in said electrolyte to a depth of several feet and wherein said hydrogen gas is supplied to more than one portion of said anode by means of separate feeds positioned at different levels of depth, the hydrogen pressure of each said feed being adjusted to a value minimizing electrolyte flooding of and percolation of hydrogen gas through said anode portions.

* * * * *